US010295177B2

(12) United States Patent
Delattre

(10) Patent No.: US 10,295,177 B2
(45) Date of Patent: May 21, 2019

(54) CANDLE WICK EXTRACTOR

(71) Applicant: Thomas Delattre, Stuart, FL (US)

(72) Inventor: Thomas Delattre, Stuart, FL (US)

( * ) Notice: Subject to any disclaimer, the term of this patent is extended or adjusted under 35 U.S.C. 154(b) by 164 days.

(21) Appl. No.: 15/490,545

(22) Filed: Apr. 18, 2017

(65) Prior Publication Data

US 2017/0321890 A1 Nov. 9, 2017

Related U.S. Application Data

(60) Provisional application No. 62/324,008, filed on Apr. 18, 2016.

(51) Int. Cl.

| | |
|---|---|
| ***F23D 3/28*** | (2006.01) |
| ***F21V 35/00*** | (2006.01) |
| ***F23D 3/16*** | (2006.01) |
| ***C11C 5/00*** | (2006.01) |

(52) U.S. Cl.
CPC ..... *F23D 3/28* (2013.01); *C11C 5/006* (2013.01); *F21V 35/00* (2013.01); *F23D 3/16* (2013.01)

(58) Field of Classification Search
CPC ..... F23D 3/28; C11C 5/006
USPC ..... 431/120
See application file for complete search history.

(56) References Cited

U.S. PATENT DOCUMENTS

| | | | | |
|---|---|---|---|---|
| 1,296,413 | A | 3/1919 | Little | |
| 5,537,989 | A | 7/1996 | York, Jr. et al. | |
| 6,045,441 | A | 4/2000 | Christensen et al. | |
| 6,619,950 | B2 | 9/2003 | Ricci | |
| 6,688,880 | B1 | 2/2004 | Pangle | |
| 6,813,832 | B2 | 11/2004 | Alexander | |
| 7,037,104 | B2 | 5/2006 | Azzinaro et al. | |
| 7,104,785 | B2 * | 9/2006 | Feaser | F23D 3/36 30/278 |
| 7,415,744 | B1 | 8/2008 | Williams | |
| 7,553,154 | B2 | 6/2009 | Jones | |
| 7,736,145 | B1 | 6/2010 | Horvath et al. | |
| 2004/0166452 | A1 | 8/2004 | McInnis | |
| 2005/0039335 | A1 | 2/2005 | Forsberg et al. | |
| 2005/0239010 | A1 | 10/2005 | Duska et al. | |
| 2008/0070171 | A1 * | 3/2008 | Dran Gula | F23D 3/28 431/120 |
| 2010/0009305 | A1 | 1/2010 | Braga et al. | |

* cited by examiner

*Primary Examiner* — Avinash A Savani
(74) *Attorney, Agent, or Firm* — McHale & Slavin, P.A.

(57) ABSTRACT

A candle wick extractor, for use with a candle having a candle wick that terminates at, proximate to, or below the top surface of a candle's wax, comprised of a rigid ergonomic handle and a tubular extension having a radial cutter on the distal end thereof. The handle is comprised of a first portion having a hand grip that is ergonomically shaped for a user to grasp, and a second portion having the tubular extension and a cutter supported longitudinally therefrom. The tubular extension is generally a hollow body having a first end and a second end. The first end is attached to a portion of the handle, whereby the central bore of the tubular extension is accessible from the top of the handle. The second end of the tubular extension supports a cutter and is adapted to be inserted longitudinally into the top wax surface of the candle with the central bore positioned over the wick.

16 Claims, 6 Drawing Sheets

CANDLE WICK EXTRACTOR

RELATED APPLICATIONS

In accordance with 37 C.F.R 1.76, a claim of priority is included in an Application Data Sheet filed concurrently herewith. Accordingly, the present invention claims priority of U.S. Provisional Patent Application No. 62/324,008, entitled "CANDLE WICK EXTRACTOR", filed on Apr. 18, 2016. The contents of the above referenced application are herein incorporated by reference in its entirety.

FIELD OF THE INVENTION

This invention relates to candles in general, and to an apparatus for extraction of wicks from within candles in order to extend a candle's useful life when the candle's existing wick becomes too short to function properly or becomes imbedded within re-solidified wax.

BACKGROUND OF THE INVENTION

A candle wick is usually a length of braided cotton extending the length of a candle that holds the flame of a candle for a set period of time depending upon the amount of wick and the amount of wax in the candle. A candle wick works by capillary action, by conveying, or "wicking", the fuel (wax) to the flame. When the liquid fuel, typically melted candle wax, reaches the flame, it then vaporizes and combusts. The candle wick influences how the candle burns, depending on the diameter, stiffness, fire-resistance, and type of material the wick is made of. For centuries, candles have been used to provide a flame that emanates light and heat. However, in modern times, candles are not utilized for primary lighting, but for artistic, aesthetic, aroma, mood setting, and even insect repellant purposes.

Typically, candles utilize at least one wick generally situated in the center of the candle and extending the entire length of the wax. Once ignited, the wick burns and heats the wax surrounding the wick. The flame forms a molten wax pool around the base of the flame. As the wax proximate to the wick continues to melt, it is absorbed by the wick and is drawn by capillary action into the flame where it is vaporized and burned into constituent combustion products. Over time, the flame moves down the wick and continues to melt the surrounding wax. A candle is typically extinguished and ignited several times, whether hourly, daily, or seasonally. However, the persistent igniting, then extinguishing, reigniting, and re-extinguishing does not allow the candle to burn long enough to create a single well in the wax, which creates several issues. For example, the wick may become buried in molten wax as the wick burns deep into a larger diameter candle, causing the heat to melt wax from the inner walls, causing a pool of molten wax that is too large for the wick to consume. Alternatively, the wax may burn unevenly and away from close proximity to the wick, which again causes more wax to melt than the wick can consume. The excessive wax often reduces the flame height or even smothers the flame. When the wax cools, the wick is then buried below the upper surface of the wax, requiring the wick to be dug out prior to relighting. Because the aperture burned by the wick is too small for a human hand, knives spoons or sharp instruments are utilized in an attempt to free the wick without breaking it off shorter, which requires even more wax extraction.

Some candles are manufactured without a wick and include a small bore through the center of the candle through which the wick is inserted after the candle is manufactured. Thus, the candle wick may be inserted or located in the center of the candle, or the candle may include multiple wicks. Typically, a small metal disc is located at the base of the candle to hold the wick(s) in place. After a candle has partially burned, the molten wax extends around the wick and seizes the wick in place, preventing any further movement of the wick. However, as discussed above, several issues may arise because of the persistent extinguishing and reigniting which creates a cavity extending downward from the top of the candle. As stated above, the cavity or extremely long burn times cause the pool of wax to become too large, and may even smother out the flame of the wick. Once the flame is extinguished, the wax hardens, encasing the wick within the hardened wax. As stated above, in an effort to reignite the wick, individuals often use conventional tools from the kitchen in an attempt to dig the wax from around the wick in an effort to expose a sufficient amount of wick to reignite the candle. In many cases, the anticipated end result cannot be accomplished and the candle is discarded or stored away for a later attempt. There is, thus, a need for a tool allowing an individual to dig out a wick from a hardened pool of candle wax.

Furthermore, candles are sometimes contained in glass, metal or porcelain vessels and can be difficult to light under the best of circumstances. Large candles capable of burning for days are frequently extinguished and reignited. As discussed above, this often leaves the ignitable end of the wick buried deep in the reformed wax, thereby making it difficult for an individual to reignite the wick. Often, individuals turn the candle upside down in an attempt to reignite the wick by applying heat to the wax in an effort to melt it away from the buried wick. This is potentially unsafe, as the hot wax can drip onto the individual's hands and causing burns. Thus, the tool for exposing the wick should include sufficient length to extend into narrow and deep candles to expose the wick, which allows for easy relighting from an upright position.

Thus, the present invention provides a tool for removing re-solidified wax from around the wick of a wax candle. The tool should be slender and elongated to allow access to narrow and deep candle cavities or candles within containers. The tool should also remove the re-solidified wax in a manner that creates a cavity around the exposed wick to prevent the wick from being smothered out upon being reignited. The tool should be tubular and include multiple cutting edges which allow hand operation, while still providing an evenly cut cavity around the wick. An ejection rod should also be included for clearing the hardened wax from the center of the tubular tool.

SUMMARY OF THE INVENTION

A candle wick extractor for use with a candle having a candle wick that terminates at, proximate to, or below the top surface of a candle's wax, comprised of a rigid ergonomic handle and a tubular extension having a radial cutter on the distal end thereof. The handle is comprised of a first portion having a hand grip that is ergonomically shaped for a user to grasp, and a second portion having the tubular extension and a cutter supported longitudinally therefrom. The tubular extension is generally a hollow body having a first end and a second end. The first end is attached to a portion of the handle, whereby the central bore of the tubular extension is accessible from the top of the handle. The second end of the tubular extension supports a cutter and is adapted to be inserted longitudinally into the top wax surface of the candle with the central bore positioned over the wick. In at least one embodiment, the second end has a diameter less than the first end and includes sharp edges along the distal end surface thereof. In at least one embodiment, the first end has a diameter of approximately 1 inch, and the second end has a diameter of approximately 0.05 inch. The second end terminates in a jagged, serrated or saw toothed edge to cut into and through candle wax, while the embodiments that include the taper allow the cut wax to be easily dumped from the larger diameter first end. In another embodiment, a shaped cutter, which may include a V or U or any other suitable shape, is supported by the second end the tubular extension for cutting a cavity around the wick to prevent smothering of the lit wick with excess wax after ignition. In this embodiment, the second end includes at least one and more, and preferably a plurality of, cutters having a sharp edge suitable for cutting the wax material. In this embodiment, wax shavings may be dumped from the candle by inverting the candle, which leaves the freed wick ready for lighting.

Accordingly, it is an objective of the present invention to provide a device for extracting the wick from solidified candle wax to allow further burning of the candle.

It is another objective of the present invention to provide a candle wick extractor and extender that has a sharp, jagged edge to cut into and through candle wax easily.

Still another objective of the present invention is to provide a candle wick extractor that is hollow providing a container for the cut away wax.

Another objective of the present invention is to provide a candle wick extractor that includes cutter(s) on a distal end thereof to provide a cavity around the extracted wick.

Other objects and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

DETAILED DESCRIPTION OF THE INVENTION

Figure 1:
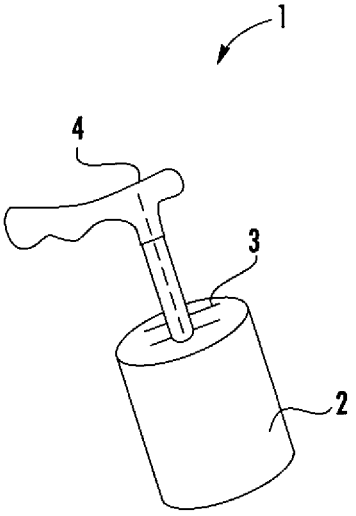
FIG. 1 is a pictorial representation of the candle wick extractor in use extracting a wick encapsulated in hardened wax.

While the present invention is susceptible of embodiment in various forms, there is shown in the drawings, and will hereinafter be described, a presently preferred, albeit not limiting, embodiment with the understanding that the present disclosure is to be considered an exemplification of the present invention and is not intended to limit the invention to the specific embodiments illustrated.

Figure 2:
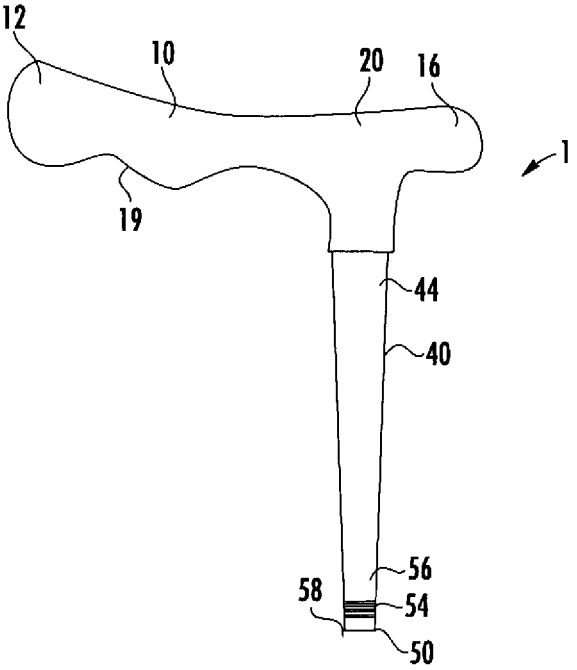
FIG. 2 is a side view of one embodiment of the candle wick extractor.
Figure 3:
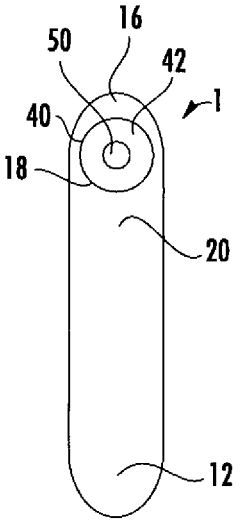
FIG. 3 is a top view of the candle wick extractor shown in FIG. 2.
Figure 4:
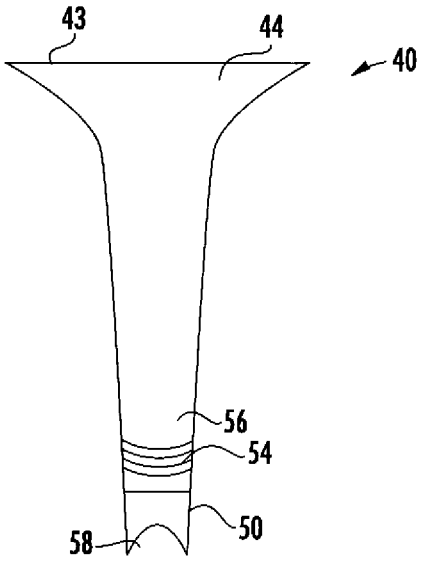
FIG. 4 is a cross-sectional view of one embodiment of the extension tube of the present invention.
Figure 5:
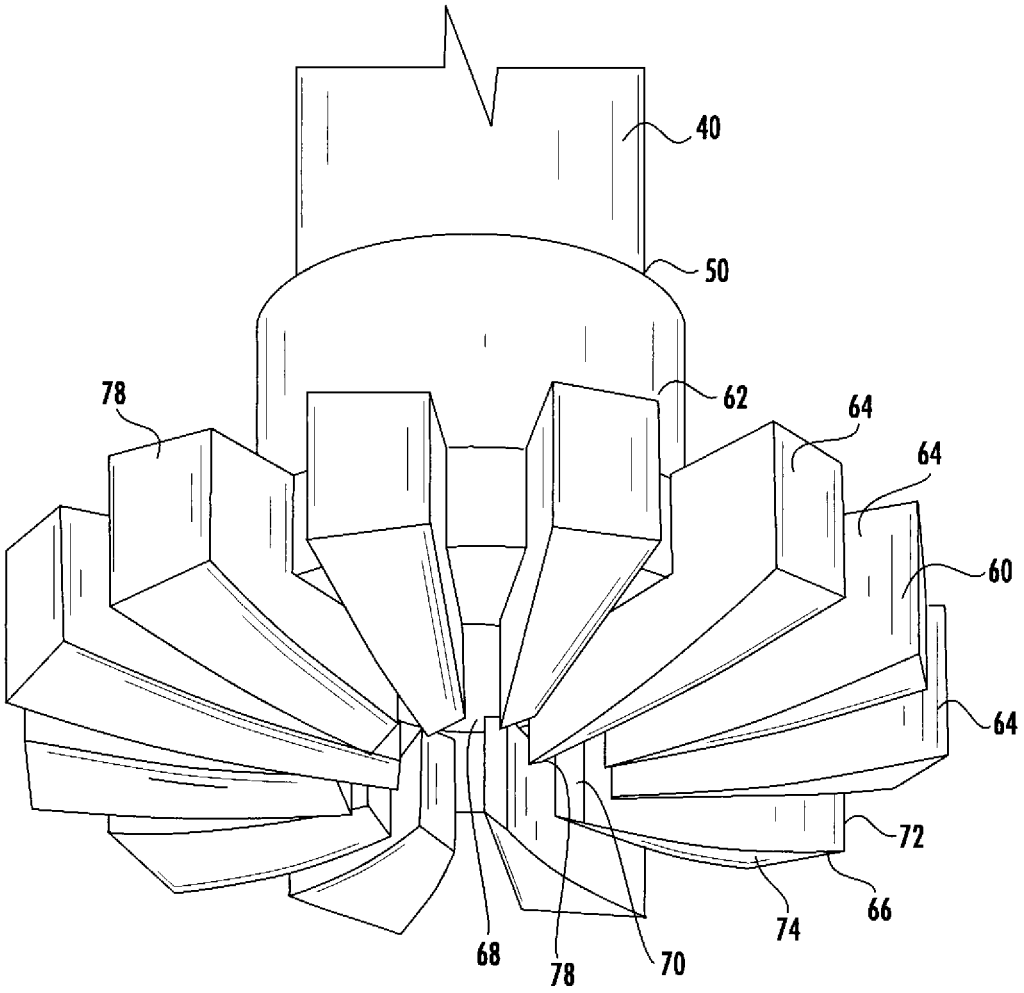
FIG. 5 is an isometric view of an alternative embodiment of the candle wick extractor illustrated with a plurality of cutters for creating a shaped cavity around the extracted wick.
Figure 6:
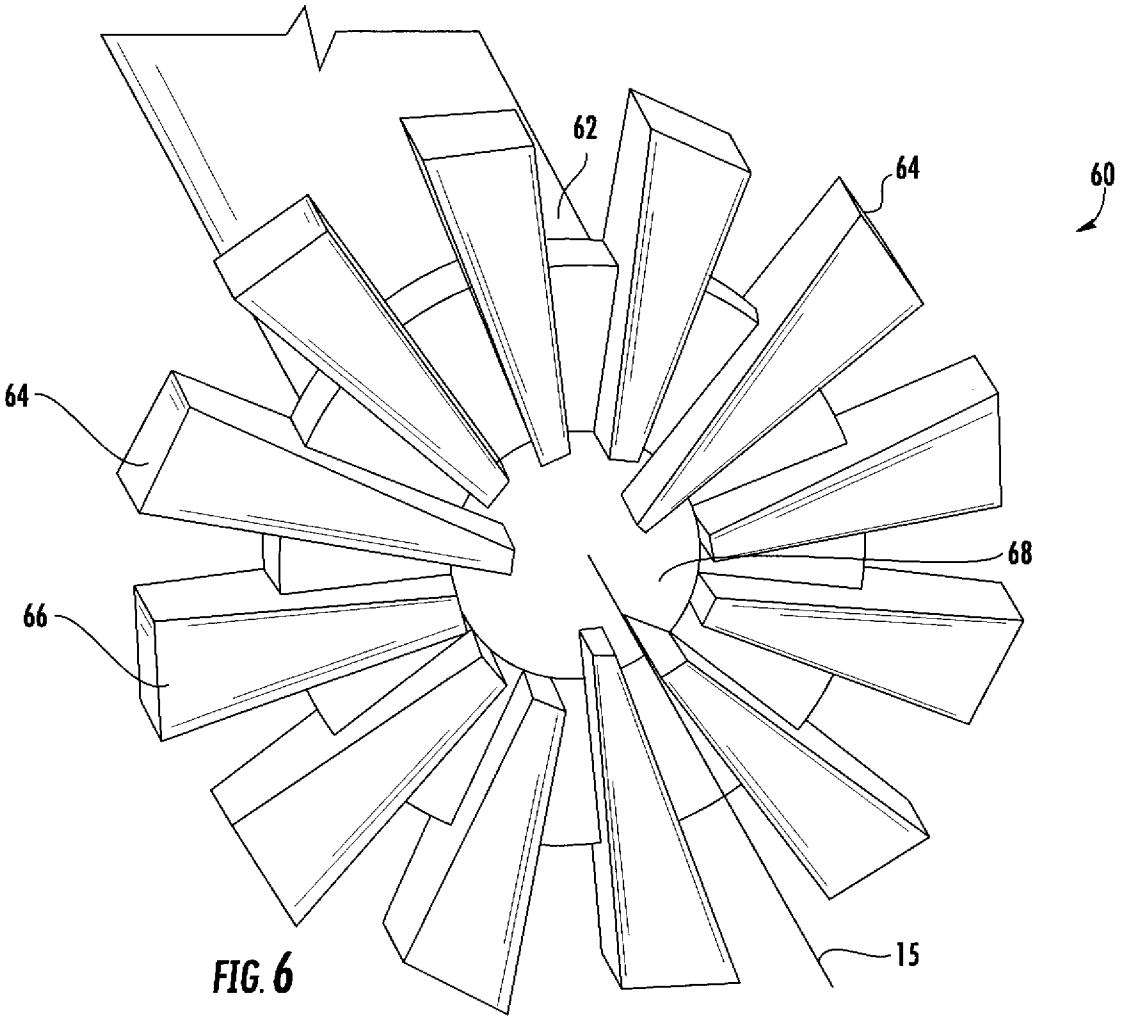
FIG. 6 is an isometric bottom view of the embodiment illustrated in FIG. 5.

Referring now to FIGS. 1-6, a candle wick extractor 1 for use with a candle 2 having a candle wick 4 that terminates at, proximate to or below the top surface of a candle's wax 3 is illustrated. The candle wick extractor 1 includes a rigid ergonomic handle 10 and an extension tube 40 depending perpendicularly therefrom. The handle 10 includes a first end 12, a second end 16 and a grip portion 14 that is ergonomically shaped for a user to grasp. The handle 10 may extend axially along the center axis 15 (FIG. 6) of the candle wick extractor or may extend at any angle, including a right angle, without departing from the scope of the invention. The extension tube 40 may be supported from the handle 10, anywhere along the length of the handle 10, having the second end 44 of the extension tube 40 opening through the top surface of the handle 10. The extension tube 40 is generally a tubular member having a first end 50 and a second end 44. The extension tube of the preferred embodiment is round in shape, however, it should be noted that any tubular shape may be utilized without departing from the scope of the invention. In one embodiment, the extension tube 40 is constructed to include a taper along its length to allow for easy dumping of the cut away hardened wax from the candle from the second end of the extension tube which opens through the handle 10. Thus, the second end 44 of the extension tube 40 is attached along the length of the handle 10 so that the lumen 42 of the extension tube is accessible from the top surface 20 of the handle 10. The first end 50 may have a diameter less than the second end 44 and include sharp edges 54 along the distal end surface 56 thereof suitable for cutting away the hardened wax. In at least one embodiment, it is contemplated that the extension tube 40 be provided without a handle and instead be provided with an oversized second end 44 having a diameter of approximately 3 inches, and the first end 50 having a diameter of approximately 0.05 inches. In this embodiment, the second end 44 of the extension tube 40 includes a roll flared distal end 43, which provides a grip for the user and provides a surface for the user's palm to apply force on the first end 50 to cut away the desired wax while leaving the wick ready to reignite. (FIG. 4) In this embodiment, the first end 50 also terminates in a jagged, serrated or knife edge 58 to aid in cutting through the candle wax 3.

Figure 7:
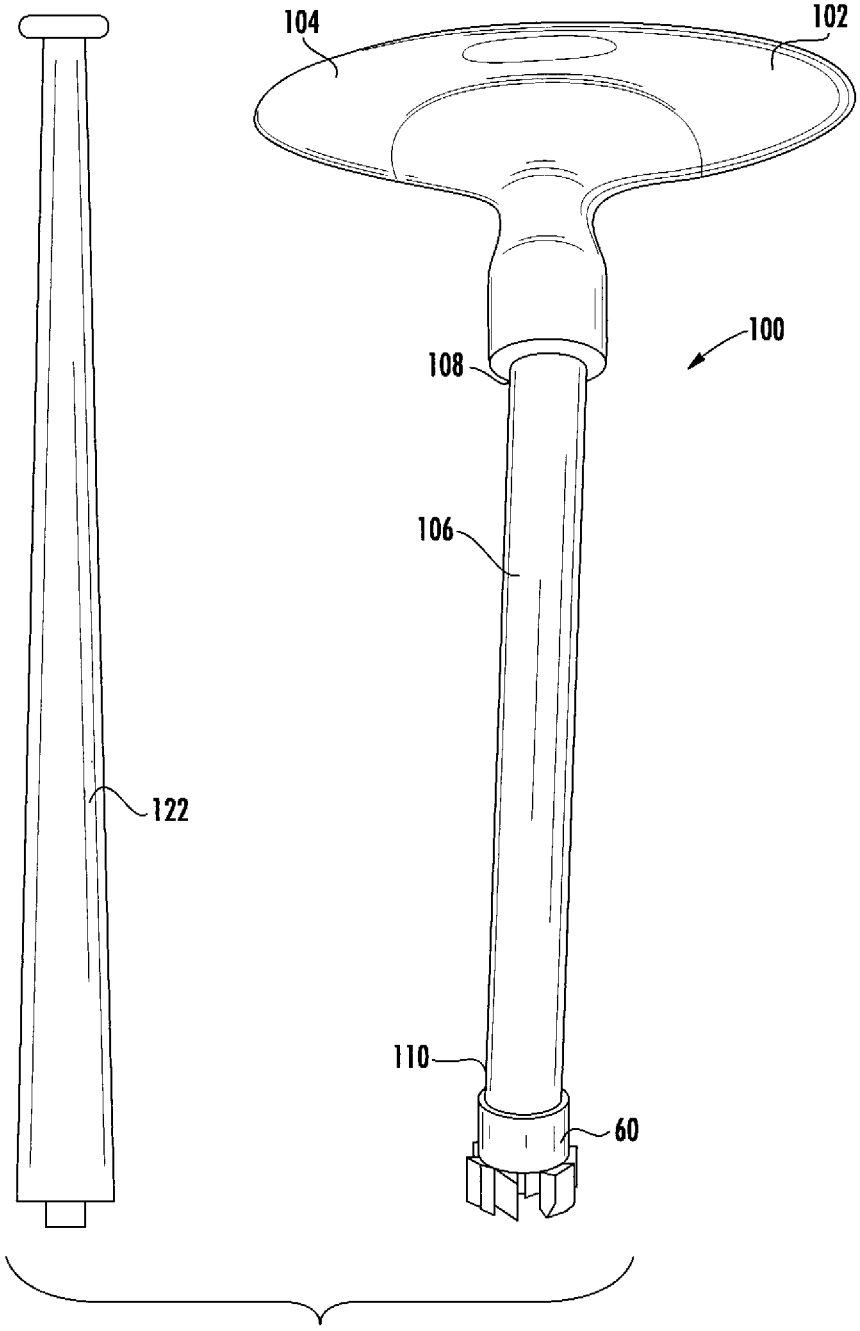
FIG. 7 is a side view of one embodiment of the candle wick extractor.
Figure 8:
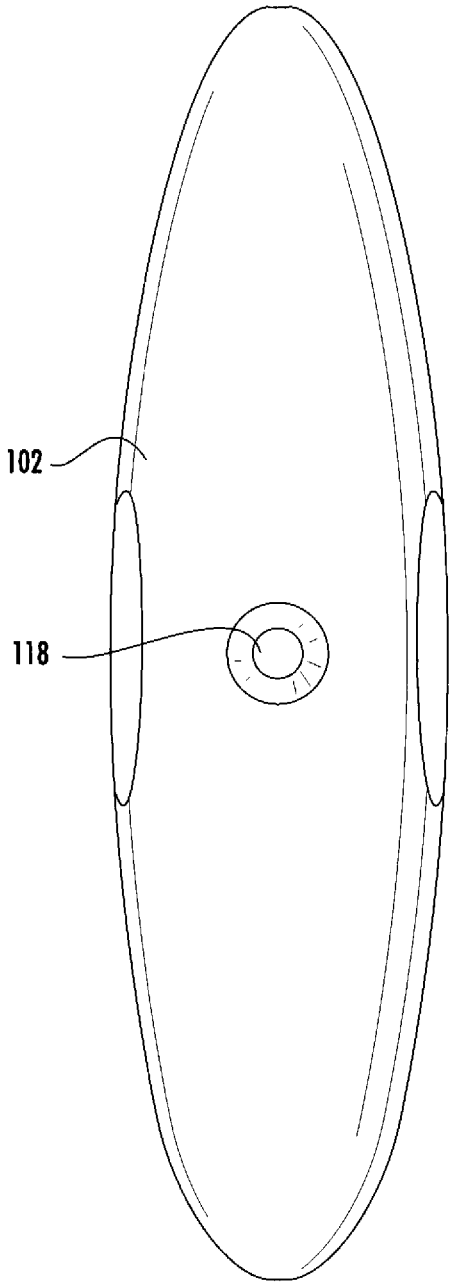
FIG. 8 is a handle end view of the embodiment illustrated in FIG. 7.
Figure 9:
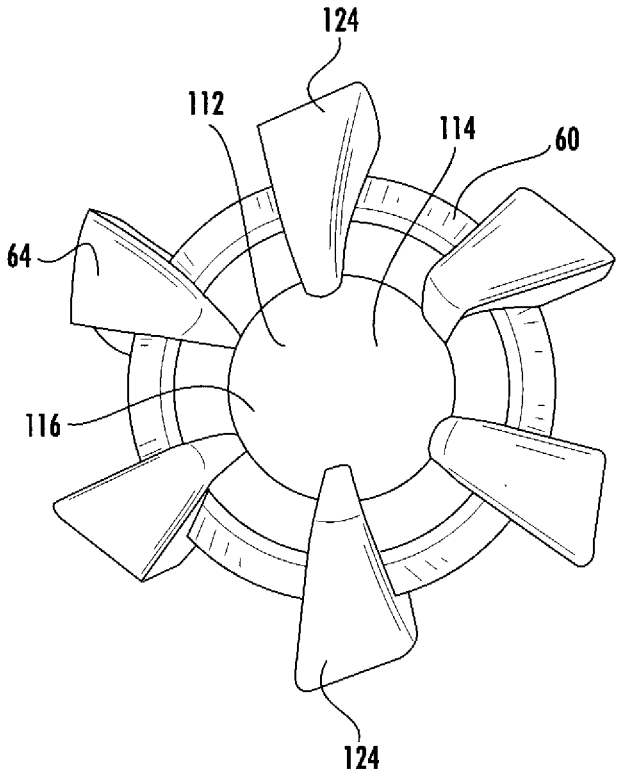
FIG. 9 is a cutter end view of the embodiment illustrated in FIG. 7.

Referring to FIGS. 5-9, an alternative embodiment of the candle wick extractor 100 is illustrated. The candle wick extractor 100 includes a handle 102 having a grip portion 104 for a human hand, an extension tube 106 extending outwardly from said handle 102, said extension tube 106 including a first end 108 secured to said handle 100 to move and rotate therewith, a second end 110 of said extension tube 106 including a cutter 60, said cutter including at least two cutter flutes 64, said cutter flutes 64 not extending to a center axis 15 of said cutter 60 to leave an uncut area 112 in the center portion of said cutter 60. A cutter lumen 114 extends through a central portion of said cutter 60, said cutter lumen 114 aligned with the extension tube lumen 116 so that the uncut area extends axially into the extension tube lumen 116. The handle further includes a handle lumen 118 extending through the handle 102 and aligned with the extension tube lumen 116. The extension tube 106 may include any tubular shape, and requires no taper along the length thereof. The handle 102 is secured to the first end 108 of the extension tube 106 by any suitable means, including over-molding, welding, fasteners and the like. The handle 102 may extend axially, at an angle or orthogonally with respect to the extension tube 106 without departing from the scope of the invention. In at least one embodiment, a center rod 122 may be provided to assist with pushing wax from the extension tube lumen 116. Thus, the center rod 122 is sized to fit through the extension tube lumen, and may include flutes, serrations or the like to assist with ejection of the cut wax.

The cutter 60 includes at least one, and more preferably, a plurality of flutes 64. The flutes 64 each include a sharp base cutting edge 66, an inner cutting edge 70 and an outer cutting edge 72. Each cutting edge includes a relief surface 74, 76 and 78 respectively. The relief surfaces provide support for the cutting edges and taper away from the cutting edges to allow the cutter to penetrate the hardened wax easily without additional drag. The cutter 60 is generally constructed and arranged to provide a larger cavity around the embedded wick, which allows melted wax a place to collect around the freed wick without smothering the flame. Thus, the central portion of the cutter 60 is provided with an aperture 68 which connects to the central aperture of the extension tube 106 to provide a path for the cut wax to travel away from the cutter. In at least one embodiment, the cutter is provided with a collar 62 having an inner bore sized and shaped to slip fit over the first end of the extension tube 106 for attaching the cutter 60 to the extension tube. Adhesive, solder, welding, fasteners or the like may be utilized to attach the cutter 60 to the extension tube 106. The cutter 60 may include any desirable shape for cutting the hardened wax from around the embedded wick. However, the preferred shape includes a lower central portion, which allows melted wax to flow to the base of the wick upon re-ignition thereof. In at least one embodiment, at least one and more preferably a pair of flutes 124 (FIG. 9) extend inwardly beyond the inner diameter of the extension tube 106 to prevent the uncut area from dragging against the inner wall of the extension tube, whereby the wick may be broken off. In addition, at least one of the cutter flutes 64 extends outwardly beyond an outer surface of the extension tube 106 to enlarge the well created by the present device. In this manner, a well may be cut into the wax of sufficient size to prevent the wick from being quickly smothered by the melting wax upon lighting of the wick.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention, and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary, and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A candle wick extractor comprising:

a handle having a grip portion for a human hand, an extension tube extending outwardly from said handle, said extension tube including a first end secured to said handle to move and rotate therewith, a second end of said extension tube including a cutter, said cutter including at least two cutter flutes, said cutter flutes not extending to a center axis of said cutter to leave an uncut area in the center portion of said cutter, a cutter lumen extending through a central portion of said cutter, said cutter lumen aligned with an extension tube lumen so that said uncut area extends axially into said extension tube lumen, said handle further including a handle lumen extending through said handle and aligned with said extension tube lumen.

2. The candle wick extractor of claim 1, wherein said handle extends axially with respect to said extension tube.

3. The candle wick extractor of claim 1, wherein said handle extends at an angle with respect to said extension tube.

4. The candle wick extractor of claim 1, wherein said handle extends orthogonally with respect to said extension tube.

5. The candle wick extractor of claim 1, wherein at least one of said cutter flutes extends outwardly beyond an outer surface of said extension tube.

6. The candle wick extractor of claim 1, wherein said cutter includes a collar portion, said collar portion having an inner diameter sized to slip fit over an outer diameter of said extension tube.

7. The candle wick extractor of claim 6, wherein said cutter is secured to said extension tube via weldment.

8. The candle wick extractor of claim 1 including a center rod, said center rod sized to fit through said extension tube lumen and said cutter lumen, said center rod being freely moveable along said center axis.

9. A hand operated candle wick extractor comprising:

a handle having an elongated tubular cutter secured thereto, said elongated tubular cutter including a hollow central lumen, a distal end of said elongated tubular cutter including a pair of cutter flutes, an inner surface of each said cutter flute being positioned adjacent to an inner wall of said central lumen, at least one of said cutter flutes extending inwardly beyond said inner wall of said central lumen, but not to a center axis of said central lumen, each said cutter flute including a base cutting edge having a relief surface for allowing each said cutter flute to penetrate hardened candle wax when said handle is rotated, leaving a core of uncut candle wax extending into said central lumen.

10. The hand operated candle wick extractor of claim 9, wherein each said cutter flute includes an inner cutting edge, said inner cutting edge including a relief surface tapering away from said inner cutting edge.

11. The hand operated candle wick extractor of claim 9, wherein each said cutter flute includes an outer cutting edge, said outer cutting edge including a relief surface tapering away from said outer cutting edge.

12. The hand operated candle wick extractor of claim 9, wherein said base cutting edge includes a lower central portion for causing wax to flow toward the base of a wick member.

13. The hand operated candle wick extractor of claim 9, wherein said handle further includes a hollow central lumen extending through said handle.

14. The hand operated candle wick extractor of claim 9, wherein said handle extends axially with respect to said elongated tubular cutter.

15. The hand operated candle wick extractor of claim 9, wherein said handle extends at an angle with respect to said elongated tubular cutter.

16. The candle wick extractor of claim 9, wherein said handle extends orthogonally with respect to said elongated tubular cutter.

* * * * *